United States Patent [19]

Ikeda et al.

[11] Patent Number: 4,533,929

[45] Date of Patent: Aug. 6, 1985

[54] HEAT-SENSITIVE RECORDING SHEET

[75] Inventors: Kensuke Ikeda; Sukenori Nakamura, both of Shizuoka, Japan

[73] Assignee: Fuji Photo Film Co., Ltd., Kanagawa, Japan

[21] Appl. No.: 554,147

[22] Filed: Nov. 21, 1983

[30] Foreign Application Priority Data

Nov. 22, 1982 [JP] Japan ..... 57-205270

[51] Int. Cl.[3] ..... B41M 5/18

[52] U.S. Cl. ..... 346/209; 346/208; 346/216; 427/150; 427/151

[58] Field of Search ..... 346/208, 209, 212, 213, 346/216, 218, 221, 224, 225; 427/150, 151

[56] References Cited

U.S. PATENT DOCUMENTS

| | | | |
|---|---|---|---|
| 4,165,398 | 8/1979 | Raine et al. | 428/341 |
| 4,168,845 | 9/1979 | Oeda et al. | 346/208 |

FOREIGN PATENT DOCUMENTS

| | | | |
|---|---|---|---|
| 2809657 | 9/1979 | Fed. Rep. of Germany | 346/212 |
| 111838 | 9/1979 | Japan | 346/209 |
| 25493 | 3/1981 | Japan | 346/212 |

*Primary Examiner*—Bruce H. Hess

*Attorney, Agent, or Firm*—Sughrue, Mion, Zinn, Macpeak & Seas

[57] ABSTRACT

A heat-sensitive recording sheet comprised of a support base having a heat-sensitive color forming layer thereon is disclosed. The layer is comprised of an electron donating dye, an electron accepting compound which reacts with the dye to form a color and a surface active agent. The surface active agent has a structure of

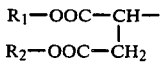

as a hydrophobic atomic group, wherein $R_1$ and $R_2$ independently represent an alkyl group having 3 to 18 carbon atoms, an aryl group having 6 to 18 carbon atoms, an aralkyl group having 7 to 18 carbon atoms, or a cycloalkyl group having 5 to 10 carbon atoms. The heat-sensitive recording sheet has high sensitivity, produces high density color images and results a reduced amount of background fog.

14 Claims, No Drawings

HEAT-SENSITIVE RECORDING SHEET

FIELD OF THE INVENTION

The present invention relates to a heat-sensitive recording sheet comprising a heat-sensitive color forming layer containing a colorless or light-colored electron donating dye and an electron accepting compound which reacts with said electron donating dye to form a color as main components, and in greater detail to a heat-sensitive recording sheet having less fogging on the background.

BACKGROUND OF THE INVENTION

Obtaining developed images by reacting an electron donating colorless dye (hereinafter referred to as "color former") with an electron accepting compound (hereinafter referred to as "color developer") with heat is well known as described in Japanese Patent Publications Nos. 14039/70 and 4160/68 (corresponding to U.S. Pat. Nos. 2,663,654 and 2,967,785, respectively). Heat-sensitive recording sheets have recently been studied with respect to their use in facsimiles.

Recently, the speed of facsimiles have been increased by obtaining faster printing-out using a heat-sensitive element. Accordingly, the heat-sensitive recording materials are required to respond in a shorter time. Recording sensitivity is increased in general in order to increase this response speed.

The recording sensitivity shows the relationship between heat energy applied to the heat-sensitive recording layer and the image density. When a heat-sensitive system forms a thick color by applying a small amount of energy, the sensitivity is said to be high. When a heat-sensitive system requires a large amount of energy to obtain a sufficient density, the sensitivity is said to be low.

Hitherto, in order to increase the recording sensitivity, efforts have been made to (1) reduce the development temperature by addition of a low melting point heat-fusible substance or by adoption of a low melting point color developer, (2) increase the efficiency of thermal conduction by improving the smoothness of the recording face, (3) increase color density by increasing the amount of the color forming components used and (4) increase development efficiency by granulating the color former or the color developer so as to have a small particle size of several μm. For example, Japanese Patent Application (OPI) 47693/82 (the term "OPI" as used herein refers to a "published unexamined Japanese patent application") has disclosed that the recording sensitivity is increased by making the color former so as to have a volume average particle size of 2 μm or less. However, though the recording sensitivity is improved by finely granulating at least one color former and the color developer, fogging on the background increases. The increase of fog on the background causes the commercial value as the recording sheets to be damaged.

SUMMARY OF THE INVENTION

As a result of earnest studies for solving the above-described disadvantage, it has been found that, in a heat-sensitive recording sheet having a heat-sensitive color forming layer containing a color former and a color developer, when a surface active agent having a structure of

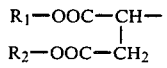

as a hydrophobic atomic group is added to said heat-sensitive color forming layer, fogging on the background does not increase even if the color former or the color developer is finely granulated. $R_1$ and $R_2$ in the above-described surface active agent may be identical or different and each represents an alkyl group having 3 to 18 carbon atoms, an aryl group having 6 to 18 atoms, an aralkyl group having 7 to 18 carbon atoms or a cycloalkyl group having 5 to 10 carbon atoms.

DETAILED DESCRIPTION OF THE INVENTION

If the carbon atom number of either $R_1$ or $R_2$ is more than 18, solubility in water remarkably deteriorates resulting in difficulties during practical use. It is particularly preferred that $R_1$ and $R_2$ in the surface active agent each represent an alkyl group having 4 to 10 carbon atoms, an aryl group having 6 to 8 carbon atoms, an aralkyl group having 7 to 10 carbon atoms or a cycloalkyl group having 6 to 10 carbon atoms in order to obtain a greater effect with respect to preventing fogging on the background.

Hydrophilic atomic groups in the surface active agent include sulfonic acid salt, carboxylic acid salt, phosphoric acid salt, amine salt, quaternary ammonium salt and pyridinium salt, etc. Sulfonic acid salt is particularly preferred due to its high solubility in water. Examples of surface active agents used in the present invention include diisobutyl sulfosuccinate, diisopentyl sulfosuccinate, dipentyl sulfosuccinate, dihexyl sulfosuccinate, diisohexyl sulfosuccinate, diheptyl sulfosuccinate, dioctyl sulfosuccinate, di-2-ethylhexyl sulfosuccinate, di-1,1-dimethyl-3-methyl-pentyl sulfosuccinate, di-1,1-dimethylheptyl sulfosuccinate, di-3-methylhexyl sulfosuccinate, dinonyl sulfosuccinate, didecyl sulfosuccinate, dibenzyl sulfosuccinate, diphenyl sulfosuccinate, diphenylethyl sulfosuccinate, dicyclohexyl sulfosuccinate and di-3-t-butylcyclohexyl sulfosuccinate, etc., preferably di-2-ethylhexyl sulfosuccinate.

Although the effect of preventing fogging is obtained by adding the surface active agent of the present invention to a coating solution just before application, it is particularly great when the surface active agent is previously added when dispersing the color former or the color developer. More preferably, the surface active agent is previously added when dispersing the color former, by which the effect of preventing fogging on the background becomes great.

The amount of the surface active agent used is decided on the basis of the solid content of the color former used, and it is 0.001 to 10 parts by weight, preferably 0.05 to 3 parts by weight, as a solid content to 100 parts by weight of the solid content of the color former. When the amount is higher than the above-described range, deterioration of sensitivity is caused. When it is lower than the above-described range, the effect of preventing fogging is not sufficient. Accordingly, the commercial value of the heat-sensitive recording sheet is damaged.

Chief color formers used in the present invention include (1) triarylmethane compounds, (2) diphenylmethane compounds, (3) xanthene compounds, (4) thiazine compounds and (5) spiropyran compounds, etc.

Examples of them are described in U.S. Pat. No. 4,283,458. Particularly, (1) triarylmethane color formers and (3) xanthene color formers are preferred, because many of them give a high color density. Examples of them include Crystal Violet lactone, 3-diethylamino-6-chloro-7-(β-ethoxyethylamino)fluoran, 3-diethylamino-6-methyl-7-anilinofluoran, 3-triethylamino-6-methyl-7-anilinofluoran, 3-cyclohexylmethylamino-6-methyl-7-anilinofluoran and 3-diethylamino-7-o-chloroanilinofluoran, etc., which may be used alone or as a mixture.

Useful color developers include phenolic compounds, organic acids and metal salts thereof, and oxybenzoic acid esters.

Examples of the phenolic compounds include 4,4'-isopropylidene-diphenol (bisphenol A), p-tert-butylphenol, 2,4-dinitrophenol, 3,4-dichlorophenol, 4,4'-methylenebis(2,6-di-tert-butylphenol), p-phenylphenol, 1,1-bis(4-hydroxyphenyl)cyclohexane, 1,1-bis(4-hydroxyphenyl)-2-ethylhexane, 2,2-bis(4-hydroxyphenyl)butane, 2,2'-methylenebis(4-tert-butylphenol), 2,2'-methylenebis-(α-phenyl-p-cresol)thiodiphenol, 4,4'-thiobis(6-tert-butyl-m-cresol), sulfonyldiphenol, p-tert-butylphenolformaldehyde condensation products and p-phenylphenolformaldehyde condensation products, etc.

Examples of organic acids and metal salts thereof include phthalic acid, phthalic acid anhydride, maleic acid, benzoic acid, gallic acid, o-toluic acid, p-toluic acid, salicylic acid, 3-tert-butylsalicylic acid, 3,5-di-tert-butylsalicylic acid, 5-α-methylbenzylsalicylic acid, 3,5(α-methylbenzyl)salicylic acid, 3-tert-octylsalicylic acid and zinc salts, lead salts, aluminum salts, magnesium salts and nickel salts of them. Particularly, salicylic acid derivatives and zinc salts or aluminum salts of them are excellent in developability, fastness of developed images and preservation stability of the recording sheets, etc.

Examples of the oxybenzoic acid esters include ethyl p-oxybenzoate, butyl p-oxybenzoate, heptyl p-oxybenzoate and benzyl p-oxybenzoate, etc.

The color developer is preferably added as a eutectic mixture with a low melting point heat-fusible substance or in a state so that a low melting point compound is fused on the surface of color developer particles so as to cause a color reaction by melting at a desired temperature.

Examples of the low melting point compounds include waxes such as higher aliphatic amides, for example, stearic acid amide, erucic acid amide, palmitic acid amide or ethylenebisstearoamide, or higher aliphatic acid esters, benzoic acid phenyl derivatives, urea derivatives such as 1-phenylurea, 1-methyl-3-phenylurea, 1-ethyl-3-phenylurea, 1,1-diethyl-3-phenylurea, 1-phenyl-3-propylurea, 3-phenyl-1,1-dipropylurea, 1-isopropyl-3-phenylurea, 1-isopropyl-3-phenyl-1-propylurea, 1,1-diisopropyl-1-dicyclohexyl-3-phenylurea, 1-(3-methoxypropyl)-3-phenylurea, 1-(3-cyclohexylpropyl)-3-phenylurea, 1-(p-methoxyphenyl)-3-butylureide, 1-(2-phenoxyethyl)-3-phenylurea, 1-benzyl-3-phenylurea, 1-(4-octadecyloxyphenyl)-3-phenylurea, 1-octadecylurea, 1-dodecyl-3-butylurea, 1-benzyl-3-butylurea, 1,1-diisobutyl-3-(1-naphthyl)urea, 1,3-dioctadecylurea, 1,1-dimethyl-3-(2,4-xylyl)urea, 4,4'-bis(3-butylureido)diphenylmethane, 2,4-bis[3-(2-butoxyethyl-)ureido]toluene or 1,6-bis(3-benzylureido)hexane, etc., urethane derivatives such as phenylcarbamoyloxydodecane, phenylcarbamoyloxyoctadecane, phenyl-3-phenylurea, 1-butyl-3-phenylurea, 1,1-dibutyl-3-phenylurea, 1-isobutyl-3-phenylurea, 1-tertiary butyl-3-phenylurea, 1-tertiary butyl-1-methyl-3-phenylurea, 1-pentyl-3-phenylurea, 1,1-dipentyl-3-phenylurea, 1-tertiary pentyl-3-phenylurea, 1-isopentyl-3-phenylurea, 1-phenyl-3-(1,2,2-trimethylpropyl)urea, 1-(1-ethyl-3-methylbutyl)-3-phenylurea, 1-(1-ethyl-2,2-dimethylbutyl)-3-phenylurea, 1-phenyl-3-(1,1,3,3-tetramethylbutyl)urea, 1-decyl-3-phenylurea, 1-(1-butylhexyl)-3-phenylurea, 1-(1-butyl-1-ethylpentyl)-3-phenylurea, 1-dodecyl-3-phenylurea, 1-octadecyl-3-phenylurea or 1-cyclohexyl-3-phenylurea, etc., and naphthol derivatives such as 2-benzyloxy-3-p-t-butylphenoxycarbonylnaphthalene, 1-benzyloxynaphthalene, 2-benzyloxynaphthalene, 2-p-chlorobenzyloxynaphthalene, 2-p-isopropylbenzyloxynaphthalene, 2-dodecyloxynaphthalene, 2-decanoyloxynaphthalene, 2-myristoyloxynaphthalene, 2-p-t-butylbenzoyloxynaphthalene, 2-benzoyloxynaphthalene, 2-benzyloxy-3-N-(3-dodecyloxypropyl)carbamoylnaphthalene, 2-benzyloxy-3-N-octylcarbamoylnaphthalene or 2-benzyloxy-3-dodecyloxycarbonylnaphthalene, etc. The urea derivatives and naphthol derivatives are more preferred.

When these low melting point compounds are used together with the color developer, they may be used alone or as a mixture of them.

The color former and the color developer are pulverized, respectively or as a mixture of them, so as to have a particle size of 10 μm or less which is dispersed in a dispersion medium. The particle size means a volume average particle size which is determined by the following relationships:

$$\frac{4}{3}\pi\left(\frac{\phi}{2}\right)^3 = \left(\frac{\text{The total volume of whole particles}}{\text{The total number of whole particles}}\right)$$

$$\phi = \left(\frac{6}{\pi} \times \frac{\text{The total volume of particles}}{\text{The total number of particles}}\right)^{\frac{1}{3}}$$

They are pulverized so as to have an average particle size of 5 μ or less, preferably 3 μ or less. The dispersion medium may be an aqueous solution of a water-soluble high polymers having a concentration of 1 to 10% by weight, examples of which include polyvinyl alcohol, hydroxyethyl cellulose, hydroxypropyl cellulose, ethylene-maleic acid anhydride copolymer, styrene-maleic acid anhydride copolymer, isobutylene-maleic acid anhydride copolymer, polyacrylic acid, polyacrylamide, starch derivatives, casein and gelatin, etc. Dispersing is carried out by means of a ball mill, a sand mill, an attritor or a colloid mill, etc. The preferred ratio of the color former to the color developer is in the range of 1:10 to 1:1 by weight, more preferably in the range of 1:5 to 3:5 by weight. Further, these water-soluble high polymers serve as binders after application. In order to give a water resisting property to the binder, it is possible to add a waterproofing agent such as gelling agent or cross-linking agent to a coating solution or to add a hydrophobic polymer emulsion such as a styrene-butadiene rubber latex or an acrylic resin emulsion.

To the heat-sensitive coating solution obtained as described above, additives are added in order to satisfy various requirements. For example, oil absorbing substances such as inorganic pigments are added to the heat-sensitive recording layer in order to prevent pollution of the recording head during recording. Further, aliphatic acids and metal soaps and the like are added in order to improve the releasing property with respect to the heat-sensitive head.

Accordingly, pigments, waxes and additives are generally applied to a support base, in addition to the color former and the color developer which directly contribute to color formation, to produce a heat-sensitive recording sheet.

Examples of the pigments include kaolin, calcined kaolin, talc, agalmatolite, diatom earth, calcium carbonate, aluminum hydroxide, magnesium hydroxide, magnesium carbonate, titanium oxide, barium carbonate, finely-divided anyhydrous silica, activated clay, urea-formaldehyde filler and cellulose filler, etc. Examples of the waxes include paraffin wax, carnauba wax, microcrystalline wax, polyethylene wax and higher aliphatic acid esters, etc.

Examples of the metal soaps include higher aliphatic acid polyvalent metal salts such as zinc stearate, aluminum stearate, calcium stearate or zinc oleate, etc. They are applied by being dispersed in the above-described water-soluble high polymers.

In the following, the present invention is illustrated in detail with reference to examples, but the present invention is not limited to these examples.

EXAMPLE 1

Dispersion A 1 g of di-2-ethylhexyl sulfosuccinate was dissolved in 1,000 g of a 5% by weight aqueous solution of polyvinyl alcohol (polymerization degree: 500, saponification degree: 99%) (Kuraray Poval PVA-105, produced by Kuraray Co.). To the solution, 200 g of 3-diethylamino-6-chloro-7-(β-ethoxyethylamino)fluoran was added and dispersed by processing in a ball mill so as to result in a particle size of 3 μm or less.

Dispersion B

A fused mixture of 100 g of bisphenol A and 100 g of stearic acid amide prepared by heating was solidified by cooling, and pulverized. It was put in 500 g of a 5% by weight aqueous solution of polyvinyl alcohol (polymerization degree: 500, saponification degree: 99%) and dispersed by processing by a ball mill for 24 hours so as to result in a particle size of 3 μm or less (volume average particle size, the same hereinafter).

The dispersion A was blended with the dispersion B. To the mixture, 250 g of calcined kaolin and 400 g of a 10% by weight aqueous solution of polyvinyl alcohol were added and dispersed again by processing in a ball mill for 5 hours. The resulting coating solution was applied to a base paper having a weight of 50 g/cm$^2$ by means of a wire bar so as to result in a solid content after being dried of 6.5 g/m$^2$, and dried at 50° C. for 5 minutes to obtain a heat-sensitive recording sheet of the present invention.

EXAMPLE 2

Dispersion C 1 g of dihexyl sulfosuccinate was dissolved in 1,000 g of a 5% by weight aqueous solution of polyvinyl alcohol (polymerization degree: 500, saponification degree: 99%). To the solution, 200 g of 3-cyclohexylmethylamino-6-methyl-7-anilidofluoran was added and dispersed by processing in a ball mill for 10 hours so as to result in a particle size of 3 μm or less.

Dispersion D 200 g of benzyl p-oxybenzoate was added to 500 g of a 5% by weight aqueous solution of polyvinyl alcohol (polymerization degree: 500, saponification degree: 99%) and dispersed by processing in a ball mill for 24 hours so as to result in a particle size of 3 μm or less.

To the dispersion D, 300 g of calcium carbonate and 400 g of a 10% by weight aqueous solution of polyvinyl alcohol were added and dispersed by processing in a ball mill for 5 hours. To the resulting dispersion, the dispersion C was added to obtain a coating solution. The resulting coating solution was applied to a base paper having a weight of 50 g/cm$^2$ by a wire bar so as to result in a solid content after being dried of 6.8 g/m$^2$, and dried at 50° C. for 5 minutes to obtain a heat-sensitive recording sheet of the present invention.

EXAMPLE 3

Dispersion E

To 1,000 g of a 5% by weight aqueous solution of polyvinyl alcohol (polymerization degree: 500, saponification degree: 99%), 200 g of 3-diethylamino-6-methyl-7-anilinofluoran was added and dispersed by processing in a ball mill for 10 hours so as to result in a particle size of 3 μm or less.

Dispersion F 200 g of bisphenol A was added to 500 g of a 5% by weight aqueous solution of hydroxyethyl cellulose and dispersed by processing in a ball mill for 10 hours so as to result in a particle size of 3 μm or less.

Dispersion E was blended with dispersion F. To the mixture, a dispersion (obtained by dispersing 200 g of amorphous silica in 500 g of a 5% by weight aqueous solution of polyvinyl alcohol by a high-speed stirrer) was added. To the resulting coating solution, 2 g of di-2-ethylhexyl sulfosuccinate was dissolved, and the solution was applied to a base paper having a weight of 50 g/cm$^2$ by means of a wire bar so as to result in a weight (after being dried) of 6.3 g/m$^2$, and dried at 50° C. for 5 minutes to obtain a heat-sensitive recording sheet of the present invention.

COMPARATIVE EXAMPLE 1

A heat-sensitive recording sheet was obtained by the same procedure as in Example 1, except that sodium dodecylbenzenesulfonate which was outside of the scope of the present invention was used instead of the surface active agent: di-2-ethylhexyl sulfosuccinate according to the present invention.

COMPARATIVE EXAMPLE 2

A heat-sensitive recording sheet was obtained by the same procedure as in Example 1, except that the surface active agent: di-2-ethylhexyl sulfosuccinate according to the present invention was not used.

COMPARATIVE EXAMPLE 3

A heat-sensitive recording sheet was obtained by the same procedure as in Example 2, except that the surface active agent: sodium butylnaphthalenesulfonate (which was outside of the scope of the present invention was used instead of the surface active agent: dihexyl sulfosuccinate according to the present invention.

COMPARATIVE EXAMPLE 4

A heat-sensitive recording sheet was obtained by the same procedure as in Example 3, except that the surface active agent: di-2-ethylhexyl sulfosuccinate according to the present invention was not used.

Fog densities on the background of the heat-sensitive recording sheets in the examples and comparative examples were measured by a Machbeth RD-918 type reflection densitometer using a visual filter. Results obtained are shown in Table 1. When the fog density on the background of the heat-sensitive recording sheet is beyond 0.100, the commercial value is damaged. Accordingly, it is understood from Table 1 that the heat-sensitive recording sheets according to the present invention are improved in that reduced fogging takes place on the background as compared to prior heat-sensitive recording sheets, because the fog density in examples is less than 0.100 while that in comparative examples is more than 0.100.

TABLE 1

| Heat-Sensitive Recording Sheet | Fog on Background |
|---|---|
| Example 1 | 0.065 |
| Example 2 | 0.060 |
| Example 3 | 0.084 |
| Comparative Example 1 | 0.130 |
| Comparative Example 2 | 0.121 |
| Comparative Example 3 | 0.110 |
| Comparative Example 4 | 0.108 |

While the invention has been described in detail and with reference to specific embodiments thereof, it will be apparent to one skilled in the art that various changes and modifications can be made therein without departing from the spirit and scope thereof.

What is claimed is:

1. A heat-sensitive recording sheet, comprising:
a support base having thereon;
a colorless or light-colored electron donating dye;
an electron-accepting compound which reacts with the dye to form a color; and
di-2-ethylhexyl sulfosuccinate as a surface active agent.

2. A heat-sensitive recording sheet as claimed in claim 1, wherein the surface active agent is present in the range of 0.001 to 10 parts by weight (solid content) per 100 parts by weight (solid content) of the electron donating dye.

3. A heat-sensitive recording sheet as claimed in claim 2, wherein the surface active agent is present in the range of 0.05 to 3 parts by weight (solid content) per 100 parts by weight (solid content) of the electron donating dye.

4. A heat-sensitive recording sheet as claimed in claim 1, wherein said electron donating dye is selected from the group of triarylmethane compounds, diphenyl methane compounds, xanthane compounds, thiazine compounds and spiropyran compounds.

5. A heat-sensitive recording sheet as claimed in claim 4, wherein said electron donating dye is selected from the group consisting of triarylmethane and xanthane compounds.

6. A heat-sensitive recording sheet as claimed in claim 4, wherein said electron donating dye is selected from the group consisting of Crystal Violet lactone, 3-diethyl-amino-6-chloro-7-(β-ethoxyethyl-amino)fluoran, 3-dimethylamino-6-methyl-7-anilinofluoran, 3-triethylamino-6-methyl-7-anilinofluoran, 3-cyclohexylmethylamino-6-methyl-7-anilinofluoran and 3-diethylamino-7-o-chloroanilinofluoran.

7. A heat-sensitive recording sheet as claimed in claim 1, wherein said electron accepting compound is selected from the group including phenolic compounds, organic acids and metal salts thereof, and oxybenzoic acid esters.

8. A heat-sensitive recording sheet as claimed in claim 7, wherein said phenolic compound is selected from the group consisting of 4,4'-isopropylidenediphenol (bisphenol A), p-tert-butylphenol, 2,4-dinitrophenol, 3,4-dichlorophenol, 4,4'-methylenebis(2,6-di-tert-butylphenol), p-phenylphenol, 1,1-bis(4-hydroxyphenyl)cyclohexane, 1,1-bis(4-hydroxyphenyl)-2-ethylhexane, 2,2-bis(4-hydroxyphenyl)butane, 2,2'-methylenebis(4-tert-butylphenol), 2,2'-methylenebis-(α-phenyl-p-cresol)thiodiphenol, 4,4'-thiobis(6-tert-butyl-m-cresol), sulfonyldiphenol, p-tert-butylphenol-formaldehyde condensation products and p-phenylphenol-formaldehyde condensation products.

9. A heat-sensitive recording sheet as claimed in claim 7, wherein the organic acids and metal salts thereof include phthalic acid, phthalic acid anhydride, maleic acid, benzoic acid, galic acid, o-toluic acid, p-toluic acid, salicylic acid, 3-tert-butylsalicylic acid, 3,5-di-tert-butylsalicylic acid, 5-α-methylbenzylsalcyclic acid, 3,5(α-methylbenzyl)salicylic acid, 3-tert-octysalicylic acid and zinc salts, lead salts, aluminum salts, magnesium salts and nickel salts thereof.

10. A heat-sensitive recording sheet as claimed in claim 7, wherein the organic acids and metal salts thereof are selected from the group consisting of salicylic acid derivatives and zinc salts or aluminum salts thereof.

11. A heat-sensitive recording sheet as claimed in claim 7, wherein said oxybenzoic acid esters are selected from the group including ethyl p-oxybenzoate, butyl p-oxybenzoate, heptyl p-oxybenzoate and benzyl p-oxybenzoate.

12. A heat-sensitive recording sheet as claimed in claim 1, wherein said electron donating dye and said electron accepting compound have a volume average particle size of 10 μm or less.

13. A heat-sensitive recording sheet as claimed in claim 1, wherein the ratio of said electron donating dye to said electron accepting compound is in the range of 1:10 to 1:1 by weight.

14. A heat-sensitive recording sheet as claimed in claim 13, wherein the ratio of said electron donating dye to said electron accepting compound is in the range of 1:5 to 3:5 by weight.

* * * * *